US006508387B1

(12) United States Patent
Simon et al.

(10) Patent No.: US 6,508,387 B1
(45) Date of Patent: Jan. 21, 2003

(54) GRAVITY FLOW SLUDGE LOAD-OUT METERING GATE

(75) Inventors: Richard D. Simon, San Rafael, CA (US); Jerry Kinzel, San Rafael, CA (US)

(73) Assignee: Material Systems Engineers, San Rafael, CA (US)

( * ) Notice: Subject to any disclaimer, the term of this patent is extended or adjusted under 35 U.S.C. 154(b) by 0 days.

(21) Appl. No.: 09/642,245

(22) Filed: Aug. 17, 2000

(51) Int. Cl.[7] ..... B67D 3/02

(52) U.S. Cl. ..... 222/561; 222/460; 251/326; 137/554

(58) Field of Search ..... 251/205, 326, 251/327, 328, 329; 222/561, 460, 185.1; 137/554; 141/297, 333

(56) References Cited

U.S. PATENT DOCUMENTS 3,319,807 A * 5/1967 Raden ..... 222/503 X
4,249,679 A * 2/1981 Dillman ..... 222/561 X
4,359,176 A * 11/1982 Johnson ..... 222/561 X
4,397,406 A * 8/1983 Croley ..... 222/460 X
4,475,672 A * 10/1984 Whitehead ..... 222/561 X
4,838,301 A * 6/1989 Lamort ..... 251/328 X
5,096,099 A * 3/1992 Wiese ..... 222/561
5,236,261 A * 8/1993 Hagenbuch ..... 222/503
5,368,276 A * 11/1994 Pfeiffer ..... 251/205 X
5,392,659 A * 2/1995 Ford et al. ..... 73/863.01
5,560,587 A * 10/1996 McCutcheon et al. ..... 251/327
5,771,926 A * 6/1998 Medal et al. ..... 137/554 X
5,895,028 A * 4/1999 Varady ..... 251/205
5,947,312 A * 9/1999 Elstone ..... 220/1.5
6,098,851 A * 8/2000 Anderson ..... 222/185.1

* cited by examiner

*Primary Examiner*—Henry C. Yuen
*Assistant Examiner*—Eric Keasel
(74) *Attorney, Agent, or Firm*—Larry D. Johnson; Craig M. Strainbrook; Johnson & Stainbrook

(57) ABSTRACT

A gravity flow sludge load-out metering gate comprising a frame having longitudinal and horizontal frame rails and a transverse rail member which defines a gate front portion and a smaller gate rear portion. A sludge inlet funnel is positioned above the front portion for insertion into the interior of a hopper discharge outlet. In the preferred embodiment, the sludge inlet funnel is substantially square and has four triangular, tapering interior sides, which, when viewed from above define an asymmetrical four-pointed star, the interior configuration of which further defines an asymmetrical diamond-shaped sludge discharge orifice. Interior to the metering gate frame is a metering gate blade, slidingly positioned between a plurality of support rollers and a bulb seal, the gate operatively connected to electric, hydraulic, or pneumatic power.

19 Claims, 11 Drawing Sheets

GRAVITY FLOW SLUDGE LOAD-OUT METERING GATE

BACKGROUND OF THE INVENTION

1. Cross Reference to Related Applications

Not applicable.

2. Field of the Invention

The present invention relates generally to sludge load out gates, and more particularly to a gravity flow sludge load-out metering gate.

3. Discussion of Related Art

It is increasingly important for wastewater treatment facilities to provide an efficient and accurate system for sludge load-out. Because numerous methods have been devised to render biological sludge generally pathogen free and suitable for reuse as soil amendment and fertilizer, there is now a large demand for treated, dewatered biosolids, particularly by fertilizer manufacturers. Further, because large and small municipalities and sewage districts have high sewage throughput and limited sludge storage capacity, the accumulation of sludge inventory cannot be tolerated. Accordingly, it is imperative to have a sludge handling system that enables rapid load out into containers for transport either to sludge customers or to disposal sites.

Such a system must provide for rapid sludge load-out with a high degree of accuracy. Rapidity is simply a summary way of stating an arithmetical fact: that in a municipality with high sewage throughput, numerous trucks must pass through sewage treatment facility load-out stations each day to handle the sludge inventory. As a practical matter, the load-out system must enable the loading of a standard eighteen-wheel container truck within only a few minutes. In itself, this would not pose much of a problem, inasmuch as sludge storage hoppers could be designed with delivery orifices that would effectively dump their contents into a truck's container. However, the load out must also be accurate in several senses. The accuracy must range over both the measurement of sludge delivered and the actual delivery, or load-out, of the sludge into container trucks. It must be measured accurately because municipalities must charge customers for sludge actually delivered, and there is no practical means for measuring sludge on the customer's end of the transaction. It must also be loaded out in a controlled fashion into the container trucks because trucks are levied a fine or surcharge for overweight loads. Finally, it must be loaded out accurately because the sludge is classified as a hazardous material and cannot be carelessly splashed and splattered in delivery. The present invention addresses the need to load-out sludge in a rapid, but controlled fashion.

A principal concern in controlling sludge load-out is handling sludge of widely varying viscosities. Viscosity fluctuations are largely unavoidable and are caused by batch variants in sludge dehydration and temperature and varying material heights, causing variable head pressure in the loading hoppers. It would therefore be desirable to provide a sludge hopper gate having a variable load-out orifice to permit fine control of the sludge flow so as to minimize splattering and sludge loss.

Accordingly, it is an object of the present invention to provide a gravity flow sludge load-out metering gate that permits highly controlled loads-out of large volumes of sludge.

SUMMARY OF THE INVENTION

The gravity flow sludge load-out metering gate of the present invention is adapted for use in any sludge load-out station where dewatered biosolids are stored and then loaded-out from storage hoppers. The metering gate may be used in either an automated or a manual system. sequence. The metering gate comprises a substantially rectangular frame having longitudinal and horizontal frame rails and a transverse rail member which defines a gate front portion and a smaller gate rear portion.

Positioned above the front portion is a sludge inlet funnel that is inserted into the interior of a hopper discharge outlet. In a first embodiment, the sludge inlet funnel has a substantially square upper perimeter and has eight triangular, tapering interior sides. When viewed from above the sides define an asymmetrical eight-sided passage having four vertices at the upper comers of the inlet funnel and having lateral edges depending downwardly from the upper corners of the inlet funnel to define an asymmetrical diamond-shaped sludge discharge orifice. This asymmetrical diamond-shaped discharge orifice is highly effective in providing tight control over gravity fed sludge flow at various sludge viscosities, thereby giving greater control over the discharge trajectory, a reduction in splashing and splattering, and the ability to load out under a higher head of sludge. Just as importantly, it prevents the accumulation of sludge in "dead spots" that will impede flow and require regular clearing and maintenance. In another embodiment, the sludge inlet funnel forms a symmetrical discharge orifice when viewed from above, and in combination with the load-out gate, described below, the symmetrical diamond-shaped discharge orifice is equally effective in providing control over the load-out process.

Interior to the metering gate frame is a substantially square metering gate blade, slidingly positioned above a plurality of support rollers, and having wings at each side passing through a slot which runs substantially the entire length of the rear portion of the each of the longitudinal frame rails. The slots acts as a metering gate blade guide during operation. The wings are operatively connected to the piston's two hydraulic, electric, or pneumatic cylinders positioned at the side of the longitudinal frame rails. Movement of the metering gate blade is powered either manually or by an electric, hydraulic, or pneumatic system. When hydraulically or pneumatically powered, the gate movement is controlled by an assembly of isolation and solenoid valves comprising a manifold from which lines direct pressurized fluid or gas to inlet valves at both ends of the cylinders. Proximity switches at each end of at least one cylinder are electronically coupled via interconnecting cables to a PLC and provide precise gate position information to the metering gate operator or automatic system.

DETAILED DESCRIPTION OF A PREFERRED EMBODIMENT

Figure 1:
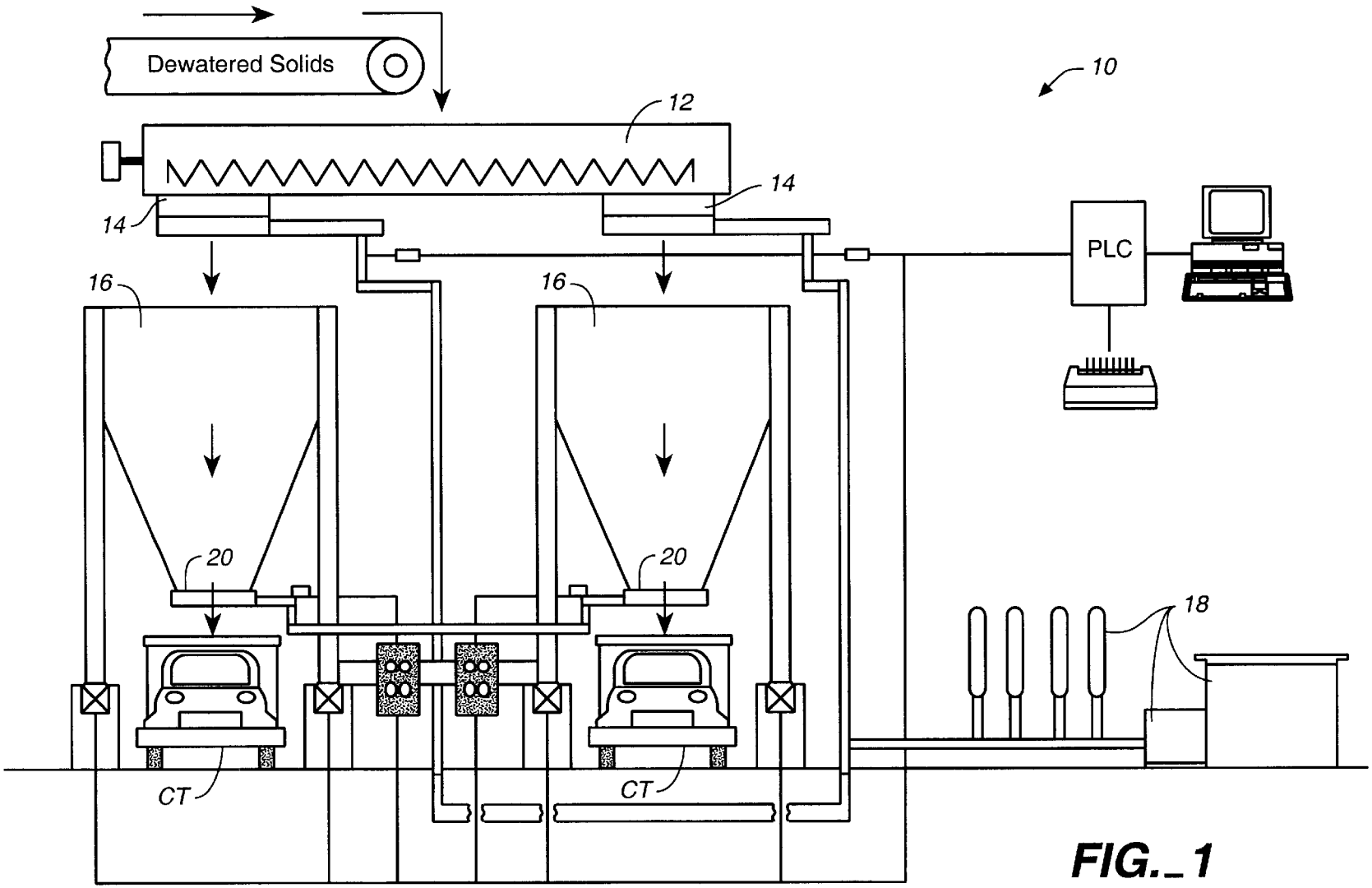
FIG. 1 is a side elevation schematic view showing the environment of use of the gravity flow sludge load-out metering gate of the present invention.

FIG. 1 is a side elevation schematic view of the environment of use of the gravity flow sludge load-out metering gate of the present invention. This view illustrates a dual station PLC controlled load-out system 10 wherein dewatered solids are conveyed from a dewatering plant (not shown) into a distribution container 12 and then through slide gates 14 into storage hoppers 16. The PLC may be programmed to control hopper loading and load-out and to modulate the position of control gates via a power system 18, which may be either hydraulic, pneumatic, or electric. The gravity flow sludge load-out metering gate of the present invention 20 is located at the base of each hopper and is positioned immediately above a container truck, CT, during a load-out sequence.

FIGS. 2 through 5 illustrate the static and dynamic elements of the gravity flow sludge load-out metering gate of the present invention. These views collectively show that the metering gate 20 generally comprises a substantially rectangular frame member 22 having first and second longitudinal frame rails, 24 and 26, first and second horizontal frame members, 28 and 30, and a transverse rail member 32 defining a gate front portion 34 and a slightly smaller gate rear portion 36. Depending on construction specifications, the horizontal frame members may comprise only end plates interposed between the longitudinal frame rails.

Immediately above front portion 34 is a sludge inlet funnel 38 which is inserted into the interior of a hopper discharge outlet. The sludge inlet funnel has a substantially square upper perimeter but has eight triangular, tapering interior sides 40*a*, 40*b*, 40*c*, 40*d*, 40*e*, 40*f*, 40*g*, and 40*h*, which, when viewed from above, as in FIGS. 2 and 4, define an asymmetrical eight-sided passage 42 (FIG. 2), having lateral edges 44 (FIG. 4) depending downwardly from each of the upper four inlet funnel comers 46 to define an asymmetrical diamond-shaped opening 48, or discharge orifice, at the bottom 35 of the inlet funnel through which sludge flows when the gate is in open in operation (described fully below). The longest horizontal dimension 50 of the discharge orifice is slightly greater in length than the longest longitudinal dimension 52 of the discharge orifice. opening 48, or discharge orifice, in the body of the star shape through which sludge flows when the gate is in open in operation (described fully below). The longest horizontal dimension 50 of the discharge orifice is slightly greater in length than the longest longitudinal dimension 52 of the discharge orifice.

The above-described asymmetrical diamond-shaped discharge orifice has been shown to be uniquely effective in providing tight control over gravity fed sludge flow at various sludge viscosities. Although a range of dimensions are possible, when each side of the sludge inlet funnel is 48 inches at each of its upper exterior edges 54*a*, 54*b*, 54*c*, and 54*d*, the tapered sides angle downwardly to define a discharge orifice at an optimal 33 inches at its longest horizontal dimension 50 and 30 inches at its longest longitudinal dimension 52; i.e., in a 1.1:1 arithmetic ratio. If the metering gate is manufactured with inlet funnel sides having upper exterior edges either shorter or longer than 33 inches, the inlet funnel sides may be downwardly tapered at substantially the same angle so as to define a discharge orifice having a longest horizontal opening dimension and a longest longitudinal dimension in the same ratio. However, the indicated ratio is not essential to proper functioning and may be tailored to complement the other features of the entire load-out system and treatment facility, particularly relating to hopper capacity, sludge viscosities, and the like.

Positioned interiorly to the metering gate frame is a substantially square metering gate blade 60, which is slidingly positioned above a plurality of support rollers 62. In a first preferred embodiment, the metering gate has a first horizontal wing 64 and a second horizontal wing 66, each passing through a slot 68 which runs substantially the entire length of the rear portion of the each of the longitudinal rail members to act as a metering gate guide during operation. Wings 64 and 66 are operatively connected to the piston (or metering gate blade actuator), 70 and 72, respectively, of a first powered cylinder (hydraulic, electric, or pneumatic) 74, preferably machined to accept a transducer 76 connected via a transducer cable 78 to a junction box (not shown), and a second powered cylinder 80, preferably machined to accept proximity or limit switches 82 at each end of the cylinder stroke. Each cylinder is positioned adjacent the longitudinal rail members at the front portion of the gate. Each cylinder has a stroke sufficient to move the gate blade to a fully open position in which the discharge orifice is fully open at its bottom.

Movement of the metering gate blade is powered either manually, or by an electric, hydraulic, or pneumatic system; if either one of the latter two, the blade movement is controlled by an assembly of isolation and solenoid valves comprising a manifold 84 from which lines 86 direct pressurized fluid or gas to inlet valves 88 at both ends of the cylinders. The proximity switches 82 at each end of at least one cylinder are electronically coupled via interconnecting cables 90 to a PLC (as shown in FIG. 1) to provide precise gate position information to the metering gate operator or automatic system. Furthermore, position sensors 92 are integrated into the power cylinders and electrically coupled with the PLC for detecting the location of the piston throughout its range. With these components (i.e., control means for monitoring and controlling the extendable pistons), the metering gate may be precisely monitored and positioned along its entire range, from a fully closed position, to a fully opened position, and throughout all intermediate positions, as the load-out need dictates.

Figure 5:
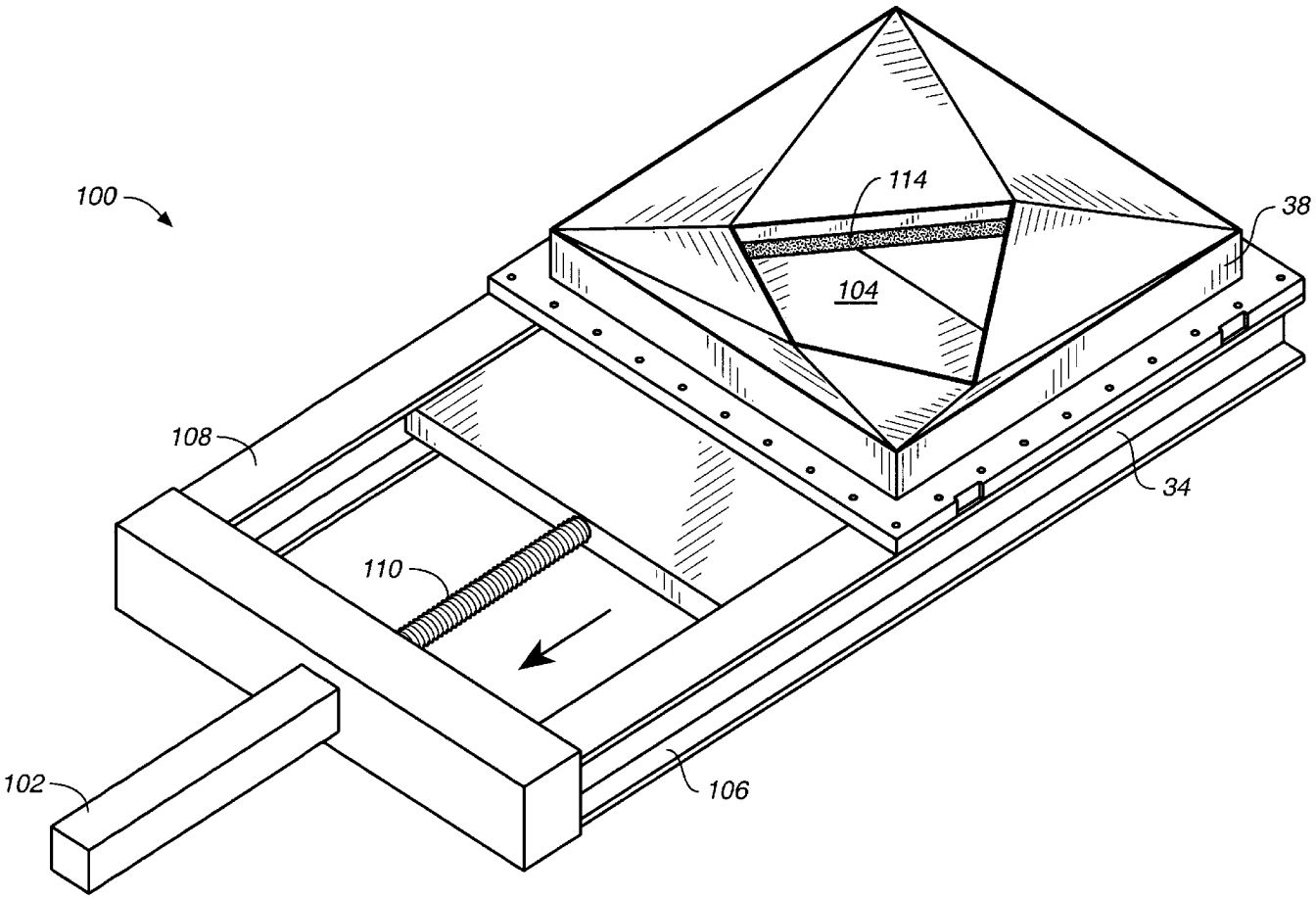
FIG. 5 is a perspective view of the structural members of a second preferred embodiment of the metering gate frame.

FIG. 5 is a perspective view showing primarily the structural members of a second preferred embodiment 100 of the metering gate frame. In this embodiment, at least one power cylinder 102 is positioned to extend outwardly from the rear portion of the gate substantially parallel to the longitudinal frame rails rather than being positioned at the sides of the longitudinal frame rails 106 and 108. It is operatively connected to the gate blade 104 by the cylinder's piston 110, which when fully extended defines a closed position of the discharge orifice, and when fully retracted defines an open discharge orifice. In this embodiment, there is no need for a gate guide slot or wings on the gate blade as the horizontal movement and the stability of the gate is provided by the piston 110 itself. This view also shows the sludge inlet funnel 38 positioned immediately above the gate front portion 34 and a strip seal 114, which allows unbound water to drain from the storage hopper through the interior of the gate while keeping sludge screening within the confines of the storage and gate system. The strip seal is positioned immediately above the metering gate blade. While the seals employed in the inventive gate (described below) ensure virtually no measurable leakage from the storage hopper, an optional drain may be incorporated for additional leak protection should the seal become breached.

Figure 2:
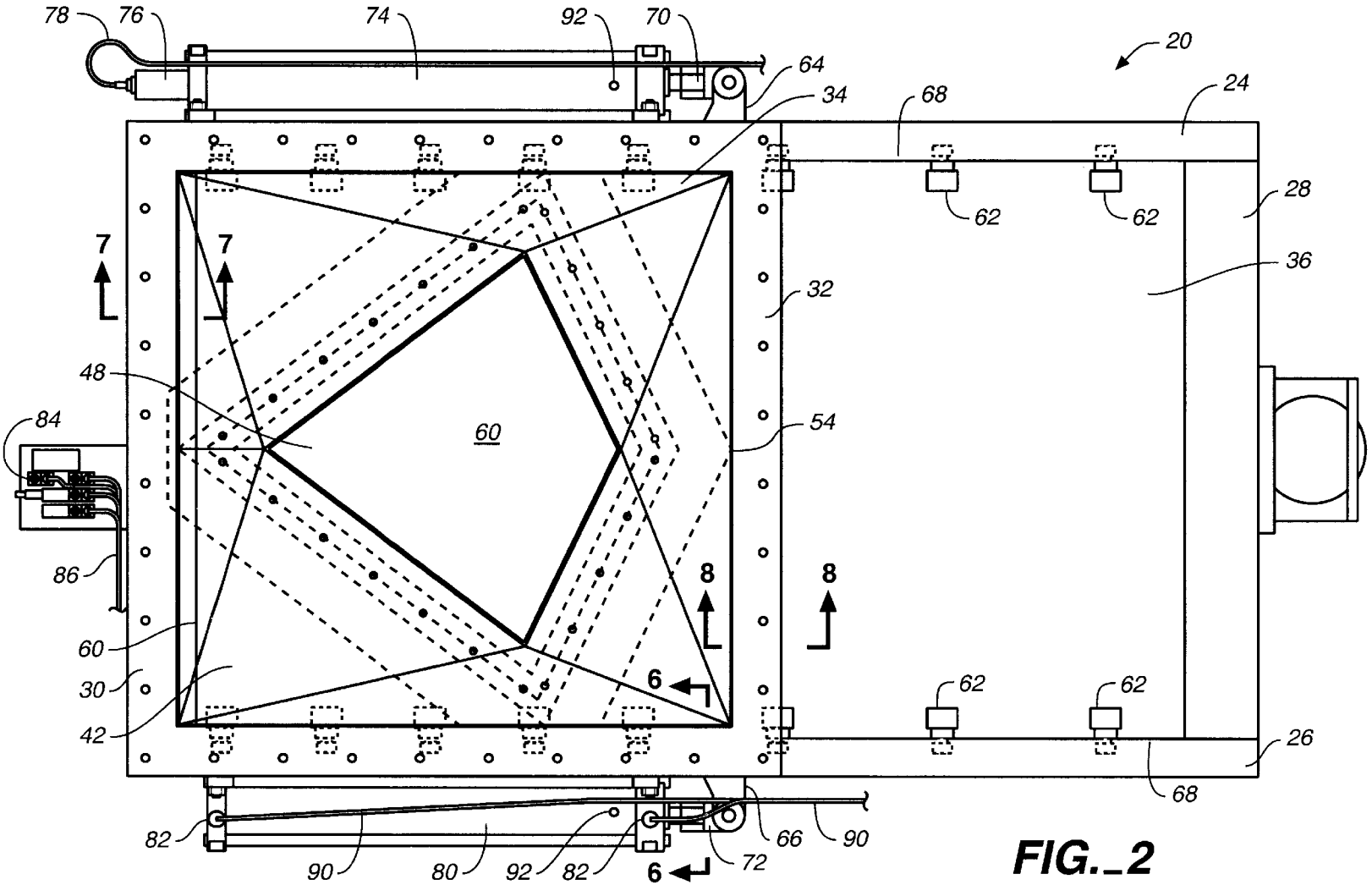
FIG. 2 is a top view of the gravity flow sludge load-out metering gate of the present invention.
Figure 3:
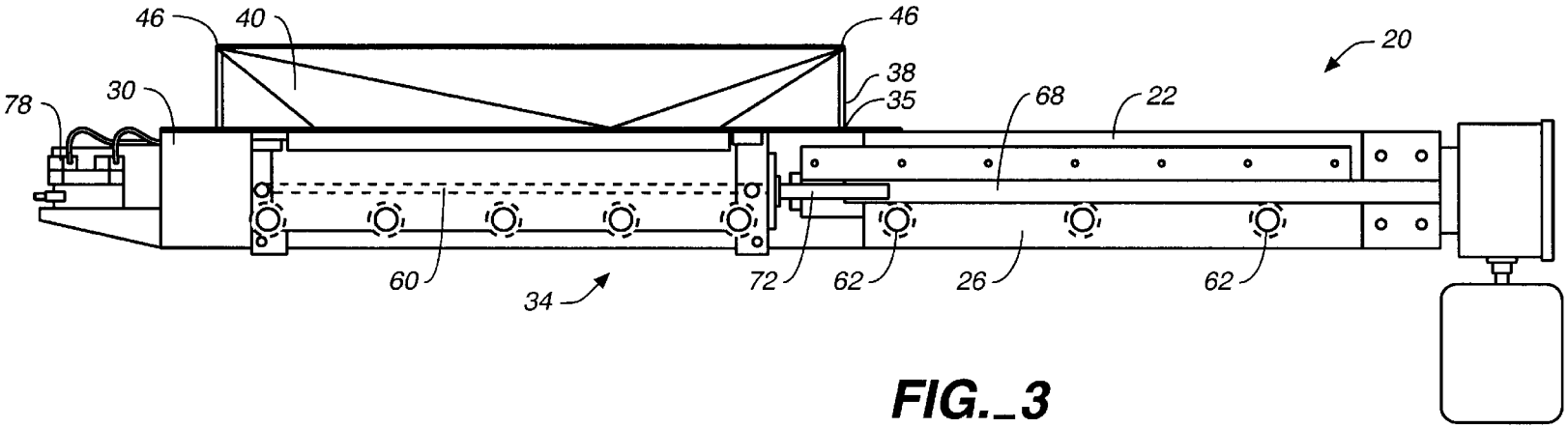
FIG. 3 is a side elevation view of the apparatus of FIG. 2.
Figure 6:
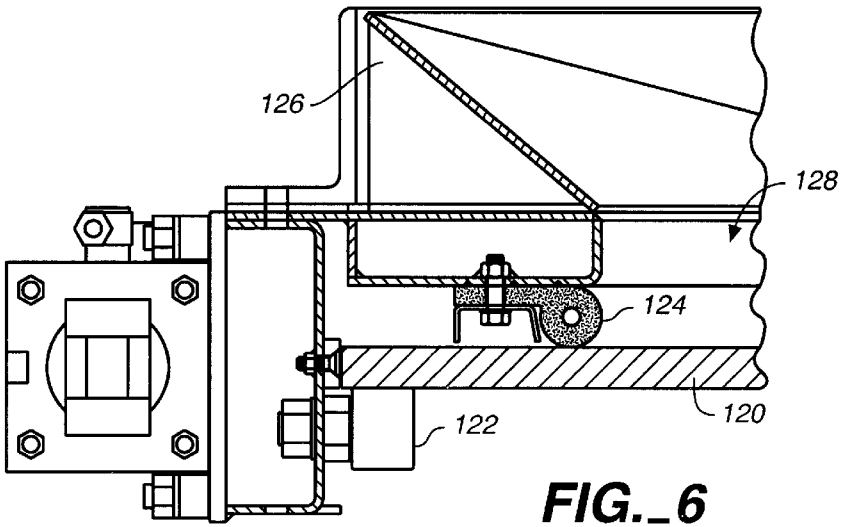
FIG. 6 is a sectional view showing detail of the gate frame side rail front section as taken along Section 6—6 as defined in FIG. 2.
Figure 4:
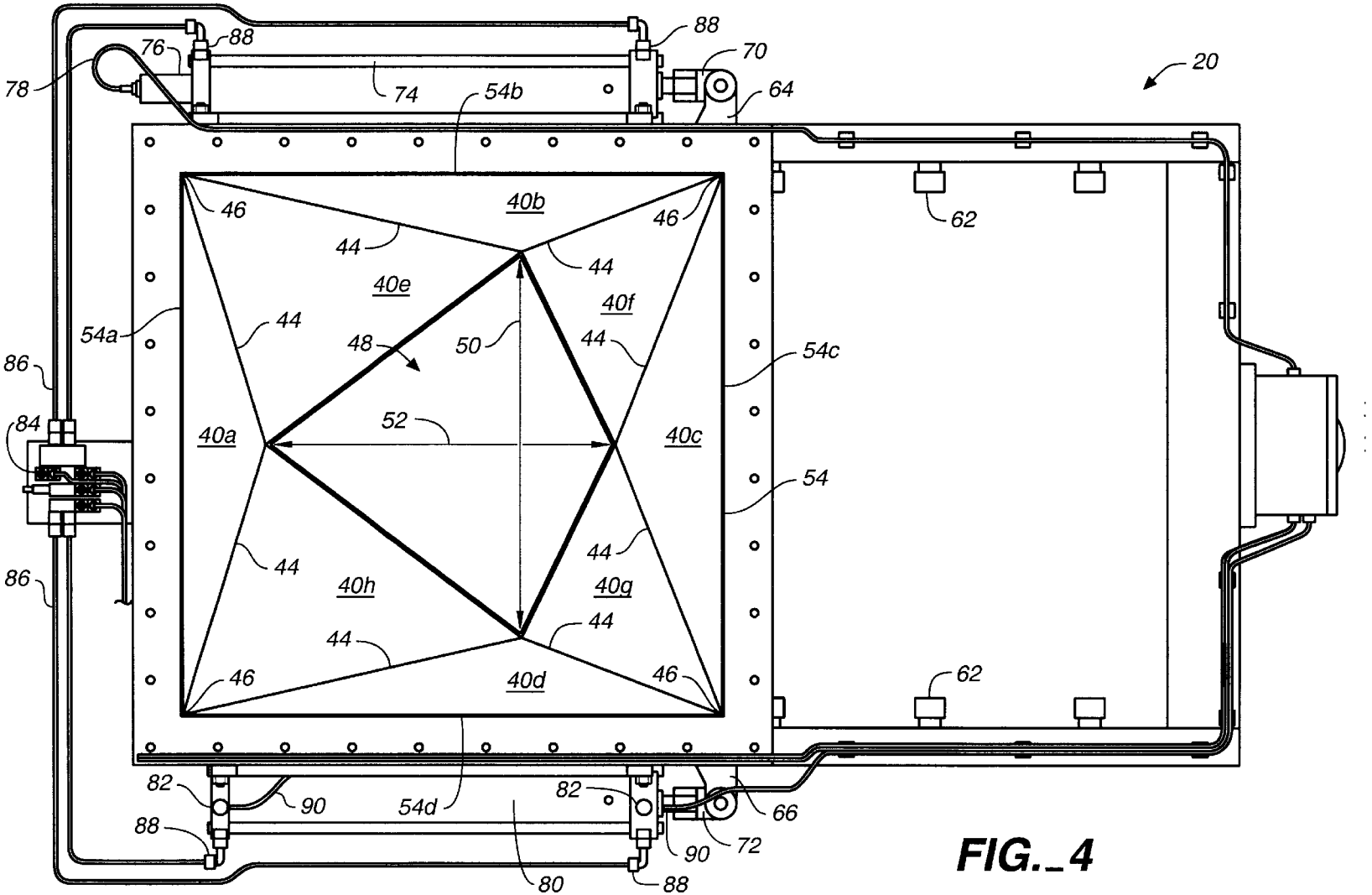
FIG. 4 is a top view of the metering gate of FIG. 2 showing detail of the hydraulic lines and valve assembly which control power for the metering gate cylinders.
Figure 7:
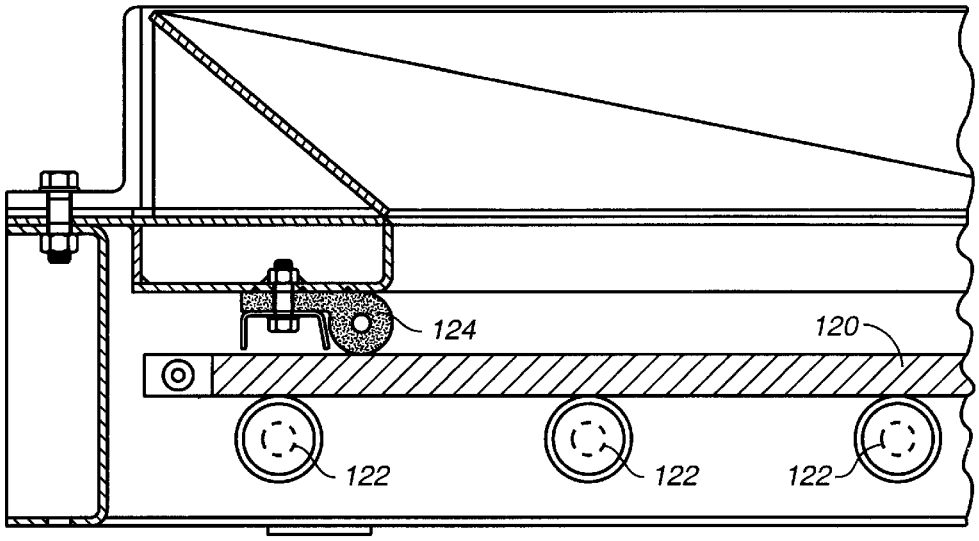
FIG. 7 is a sectional view showing detail of the gate front end as taken along Section 7—7 as defined in FIG. 2.
Figure 8:
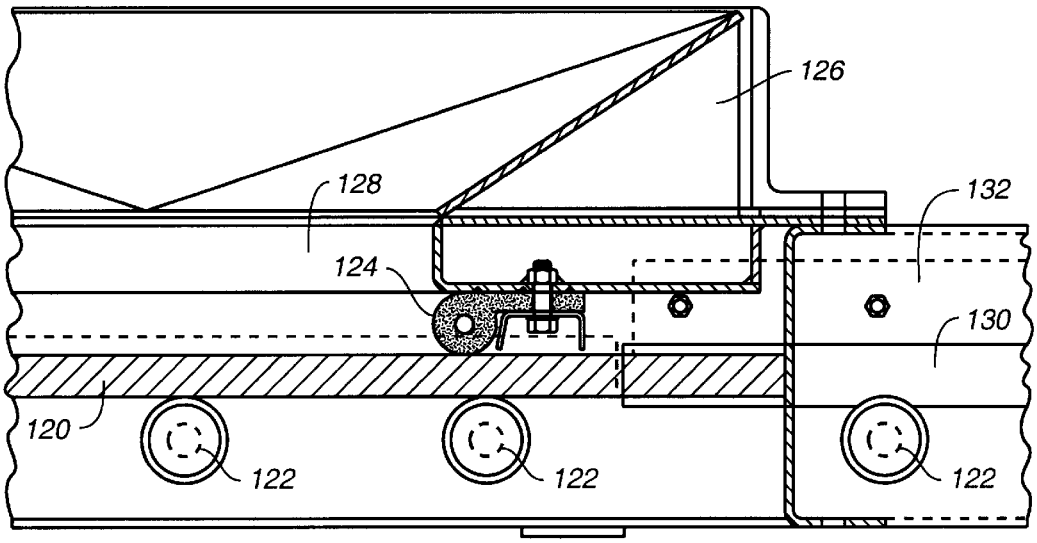
FIG. 8 is a sectional view showing detail of the rear flange as taken along Section 8—8 as defined in FIG. 2.

FIGS. 6 through 8 provide detailed views of defined portions of the sludge load-out metering gate of FIG. 2. FIG. 6 is a sectional view showing detail of the gate frame side rail front as taken along Section 6—6 of FIG. 2; FIG. 7 is a sectional view showing detail of the gate front end as taken along Section 7—7; and FIG. 8 is a sectional view showing detail of the rear flange as taken along Section 8—8. These views show that metering gate blade 120 is interposed between support roller 122*s* and a bulb seal 124 which prevents fluid leakage from free water accompanying sludge contained in the sludge inlet funnel 126 and trapped in the discharge outlet 128. The bulb seal is preferably fabricated of neoprene and by virtue of the force exerted onto the gate blade provides an extremely tight seal while simultaneously allowing free movement of the gate blade. The bulb seal runs substantially the entire length and width of the metering gate blade at its edges at the front portion of the gate. FIG. 8 further shows detail of the gate blade guide 130 defined by the slot running horizontally along the length of frame rail 132.

Figure 9:
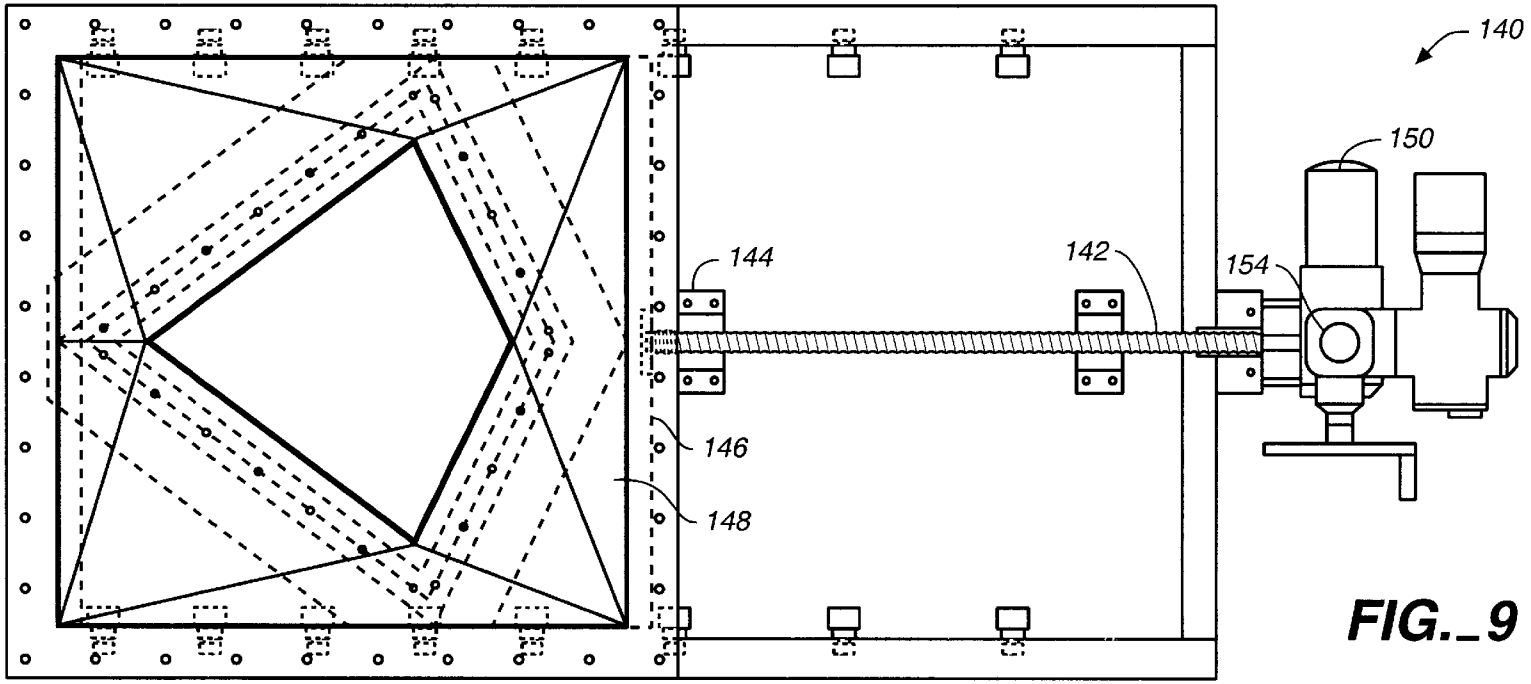
FIG. 9 is a top plan view of a third preferred embodiment of the metering gate of the present invention, showing a manually powered gate.
Figure 10:
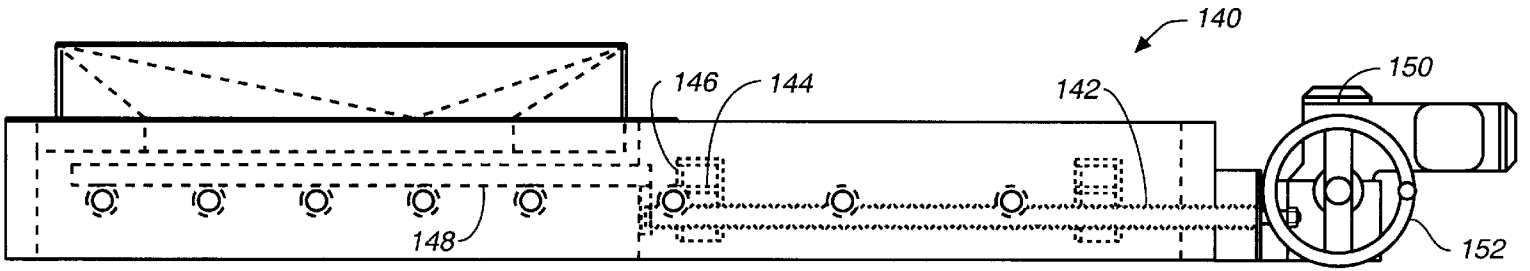
FIG. 10 is a side elevation view of the gate of FIG. 9.

FIGS. 9 and 10 are a top plan view and a side elevation view, respectively, of a third preferred embodiment of the metering gate of the present invention. These views illustrate a manually powered metering gate 140 having a threaded operating stem 142 threadably connected to a stem nut 144, said stem nut integrally connected to the rear end 146 of the metering gate 148. The operating stem extends outwardly from the transverse rail member at the gate's rear portion substantially parallel to the longitudinal rail members, and there it is operatively connected to an actuator 150 comprising a rotatable handle 152 and a gear assembly 154 for translating the handle rotation into rotation of the operating stem, as is well known in the art. Thus, simple rotation of the actuator handle provides simple, direct, and precise control of gate movement.

Figure 11A:
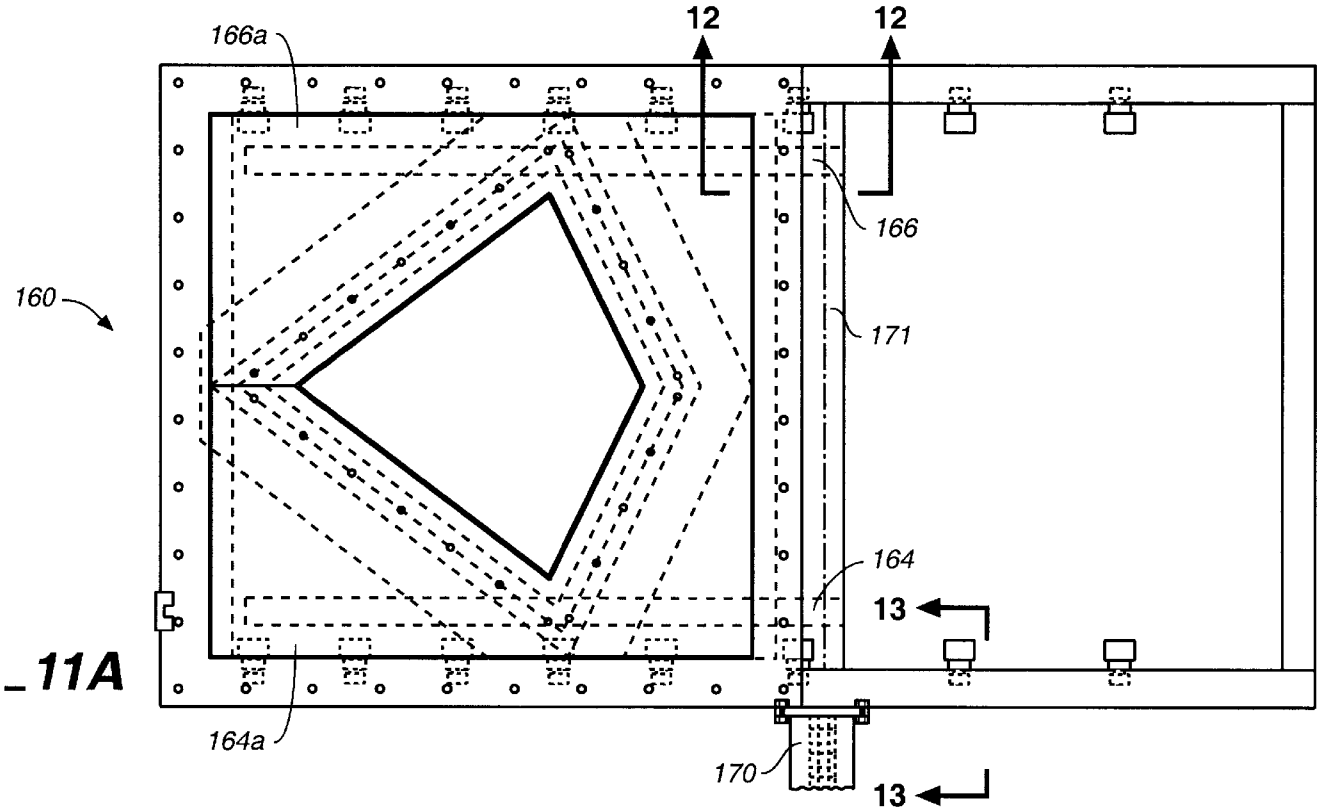
FIG. 11*a* is a top plan view of a fourth preferred embodiment of the metering gate of the present invention, showing a rack and pinion actuating mechanism.
Figure 11B:
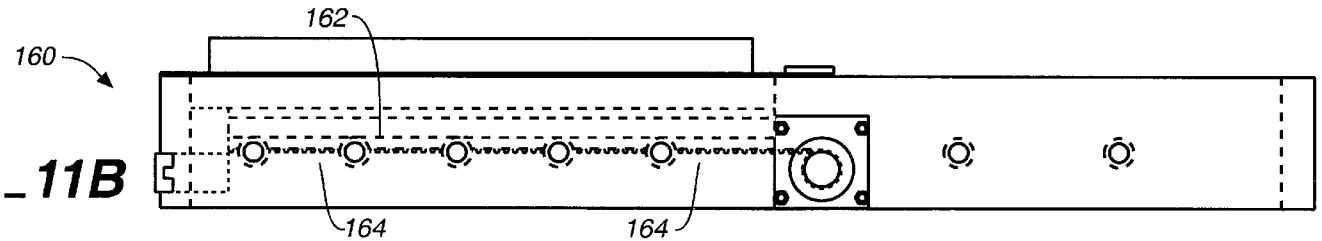
FIG. 11*b* is a side elevation view of the metering gate of FIG. 11*a;*
Figure 12:
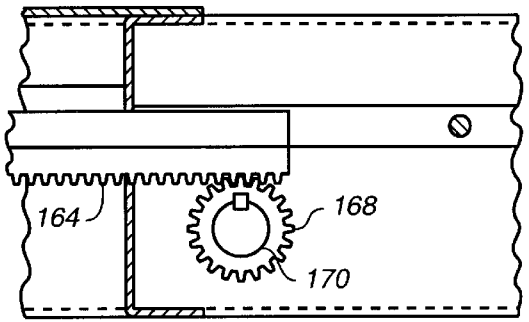
FIG. 12 is detailed view of the rack and pinion assembly shown in FIGS. 11 and 12, as taken along the sectional lines 12—12 in FIG. 11*a;*
Figure 13:
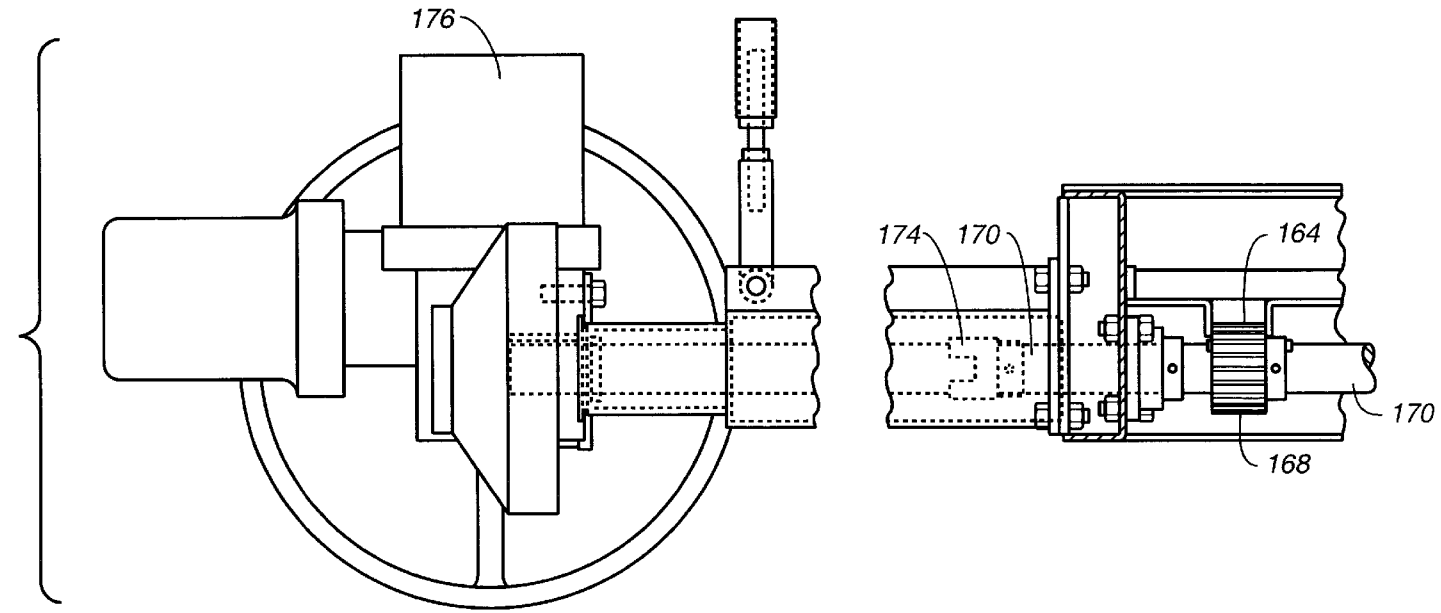
FIG. 13 is a detailed view of the rack and pinion assembly shown in FIGS. 11 and 12, as taken along sectional lines 13—13 of FIG. 11*a;*

FIG. 11*a* is a top plan view and FIG. 11*b* is a side elevation view of a fourth preferred embodiment 160 of the metering gate of the present invention, showing a rack and pinion assembly for gate blade operation. FIG. 12 is a detailed view of the rack and pinion assembly shown in FIGS. 11*a*, 11*b*, and 12, taken along section lines 12—12 of FIG. 11*a*. FIG. 13 is a detailed view of the rack and pinion assembly shown in FIGS. 11*a* through 12 taken along section lines 13—13 of FIG. 11*a*. These four views show a rack and pinion actuating mechanism adapted for use with any of the above-mentioned powering means, in this instance illustrated as a manually powered system. This rack and pinion embodiment, like the second and third embodiments, eliminates the need for wings on the metering gate. The metering gate blade 162 has a first gear rack 164 and a second gear rack 166, each integral with respective sides, 162*a* and 164*a*, of the metering gate blade, and each adapted for engagement with a pinion gear 168 concentric with a pinion shaft 170 running the width of the gate at the transverse frame member. Emerging from one side of the metering gate is a pinion shaft extension 172 housing the pinion shaft, which is coupled to a compensating shaft 174 that extends outwardly from the gate and is operatively connected to a power source, for example an actuator 176, such as that shown and described above in relation to the third preferred embodiment.

Figure 14:
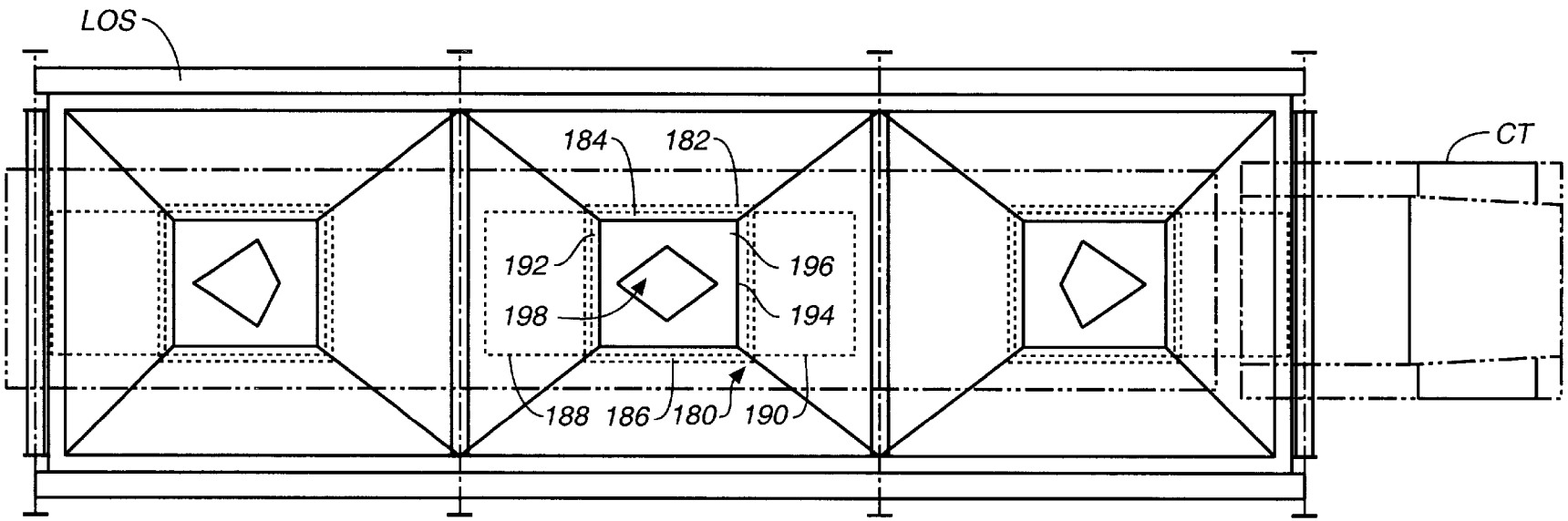
FIG. 14 is top plan view of a fifth preferred embodiment of the metering gate of the present invention, shown in its working environment.
Figure 15:
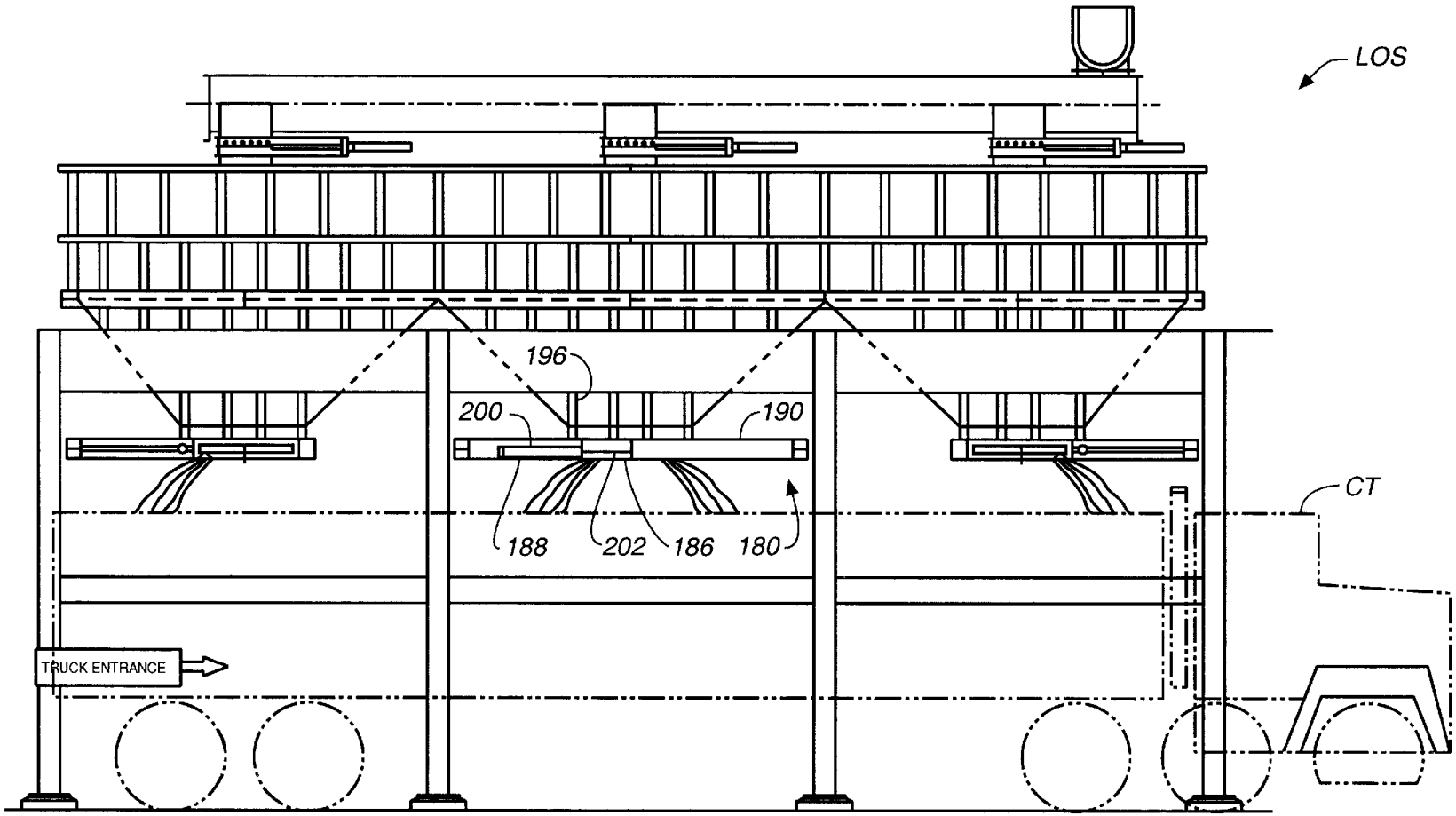
FIG. 15 is a side elevation of the gate and its environment shown in FIG. 14.

FIGS. 14 and 15 are top and side elevation views of a fifth preferred embodiment 180 of the metering gate of the present invention, each view showing the gate in its working environment, namely a three-bay load-out station LOS with a container truck CT positioned for a load-out operation. The gate of the fifth preferred embodiment, the frame 182 of which is shown in phantom in FIG. 14, incorporates the structural and operative features of the above-described first through fourth embodiments, but rather than having a metering gate blade 84 that moves in one direction only, the blade moves in two directions. The gate thus includes a middle portion 186 where the discharge outlet is located, and this middle portion is bordered by a first and second blade opening portions, 188 and 190, into which the blade may be moved when the blade is opened. The portions are defined by first and second transverse rail members, 192 and 194. Furthermore, the sludge inlet port 196 above this embodiment defines a symmetrical four-pointed star sludge discharge orifice 198, rather than an asymmetrical star, as in the previous embodiments. The combination of tightly controlled gate opening and discharge orifice geometry provides the same flow control characteristics of the asymmetrical sludge discharge orifice incorporated into the first through fourth preferred embodiments. In this fifth preferred embodiment, the gate blade is closed when the piston 200 is in a neutral position 202. When the piston is actuated to retract, it pulls the gate open in one direction; and when the piston is actuated to extend, it pushes the gate open in the opposite direction. Because the direction of sludge flow through the diamond-shaped gate is dramatically altered when opening the gate in one direction rather than the other, the load-out process can be controlled to deliver sludge both toward the front of the container truck and toward the rear of the container truck, thus balancing the load.

What is claimed as invention is:

1. A gravity flow sludge load-out metering gate, comprising:

a front portion and a rear portion;

a frame having longitudinal and horizontal frame rails;

a transverse frame member defining said front portion and said rear portion;

a sludge inlet funnel positioned above said front portion, said sludge inlet funnel having a substantially square upper perimeter and having eight triangular, tapering interior sides, which, when viewed from above define an asymmetrical eight-sided passage, the interior configuration of which further defines an asymmetrical diamond-shaped sludge discharge orifice at the bottom of said inlet funnel;

a metering gate blade, slidingly positioned above a plurality of support rollers; and a metering gate blade actuator for moving said metering gate blade longitudinally along the length of said longitudinal rails.

2. The gravity flow sludge load-out metering gate of claim 1 wherein said metering gate blade actuator comprises at least one hydraulically powered piston operatively connected to said metering gate blade.

3. The gravity flow sludge load-out metering gate of claim 1 wherein said metering gate blade actuator comprises at least one pneumatically powered piston operatively connected to said metering gate blade.

4. The gravity flow sludge load-out metering gate of claim 1 wherein said metering gate blade actuator comprises at least one electrically powered piston operatively connected to said metering gate blade.

5. The gravity flow sludge load-out metering gate of claim 1 wherein said longitudinal frame rails define a horizontal slot in said rear portion of said metering gate, and wherein said metering gate blade further comprises at least one metering gate blade wing integral with said metering gate blade, said wing passing through the horizontal slot and connected to said metering gate blade actuator.

6. The gravity flow sludge load-out metering gate of claim 1 wherein said metering gate blade actuator comprises at least one powered cylinder having an extendable piston operatively connected to said metering gate blade.

7. The gravity flow sludge load-out metering gate of claim 6 wherein said at least one powered cylinder is positioned adjacent said longitudinal frame rails at the front portion of said metering gate.

8. The gravity flow sludge load-out metering gate of claim 6 wherein said at least one powered cylinder is positioned to extend outwardly from the rear portion of said metering gate substantially parallel to said longitudinal frame rails, and wherein said extendable piston defines a closed discharge orifice when in the fully extended position and an open discharge orifice when in the retracted position.

9. The gravity flow sludge load-out metering gate of claim 6 further comprising control means for monitoring and controlling said extendable piston.

10. The gravity flow sludge load-out metering gate of claim 9 wherein said control means comprises at least one proximity switch and at least one position sensor electrically coupled to a PLC.

11. The gravity flow sludge load-out metering gate of claim 1 further comprising:

a drain; and a strip seal positioned immediately above said metering gate blade for channeling unbound water into said drain.

12. The gravity flow sludge load-out metering gate of claim 1 further comprising a bulb seal positioned in the front portion of said metering gate above said metering gate blade and running substantially the entire length and width of said metering gate blade at its edges.

13. The gravity flow sludge load-out metering gate of claim 12 wherein said bulb seal is fabricated of neoprene and exerts a force onto said metering gate blade sufficient to prevent fluid leakage from free water accompanying sludge contained in the sludge inlet funnel and trapped in the discharge orifice while simultaneously allowing free movement of the metering gate blade.

14. The gravity flow sludge load-out metering gate of claim 1 wherein said metering gate blade actuator comprises:

a threaded operating stem;

an actuator operatively connected to said operating stem and having a rotatable handle and a gear assembly for translating handle rotation into rotation of said operating stem; and a threaded stem nut threadably mated to said threaded operating stem, said stem nut integrally connected to the rear end of said metering gate blade.

15. The gravity flow sludge load-out metering gate of claim 1 wherein said metering gate further comprises a rack and pinion assembly, said assembly comprising:

a first gear rack and a second gear rack, each integral with the first and second side, respectively, of said metering gate blade, said first and second gear rack adapted for engagement with a pinion gear concentric with a pinion shaft running the width of the gate at said transverse rail member, said pinion shaft extending outwardly from one of said longitudinal frame members for operative coupling to said metering gate blade power means.

16. A gravity flow sludge load-out metering gate, comprising:

a front portion, a middle discharge portion, and a rear portion;

a frame having longitudinal and horizontal frame rails;

a first and a second transverse frame member, said transverse frame members defining said front, middle and rear portions;

a sludge inlet funnel positioned above said front portion, said sludge inlet funnel having a substantially square upper perimeter and having eight triangular, tapering interior sides, which define a diamond-shaped sludge discharge orifice at the bottom of said inlet funnel;

a metering gate blade slidingly positioned above a plurality of support rollers; and a metering gate blade actuator for moving said metering gate blade longitudinally along the length of said longitudinal frame rails.

17. The gravity flow sludge load-out metering gate of claim 16, wherein said discharge orifice is a symmetrical.

18. The gravity flow sludge load-out metering gate of claim 16, wherein said discharge orifice is asymmetrical.

19. The gravity flow sludge load-out metering gate of claim 16 wherein said metering gate blade actuator comprises at least one powered piston operatively connected to said metering gate blade.

* * * * *